United States Patent [19]

Colquitt

[11] 4,227,338

[45] Oct. 14, 1980

[54] THERMOMETER AND DOLL HAVING CAPACITY TO REGISTER TEMPERATURE

[76] Inventor: Walter D. Colquitt, 18673 Wisconsin, Detroit, Mich. 48221

[21] Appl. No.: 932,765

[22] Filed: Aug. 11, 1978

[51] Int. Cl.[3] ..... A63H 33/26; A63H 3/36; A63H 11/00; G09B 23/28

[52] U.S. Cl. ..... 46/45; 46/164; 46/171; 46/116; 46/135 R; 35/17

[58] Field of Search ..... 46/1 F, 164, 171, 135 R, 46/228, 116, 45, 227; 35/9 C, 17

[56] References Cited

U.S. PATENT DOCUMENTS

| | | | |
|---|---|---|---|
| 3,239,961 | 3/1966 | Forkner | 46/228 |
| 3,514,899 | 6/1970 | Bonanno et al. | 46/118 |
| 3,918,199 | 11/1975 | DeMasi | 46/264 |
| 4,075,782 | 2/1978 | Newschatz | 35/17 |

*Primary Examiner*—Louis G. Mancene
*Assistant Examiner*—Michael J. Foycik, Jr.
*Attorney, Agent, or Firm*—Arnold S. Weintraub

[57] ABSTRACT

An electric circuit, including a power source and a resistive heating element, is provided within the body of a doll. The circuit is completed by the insertion of a thermometer into an aperture provided in the body of the doll, and the heat generated by the resistive heating element is registered on the thermometer, thereby creating the effect of "taking the doll's temperature."

11 Claims, 5 Drawing Figures

THERMOMETER AND DOLL HAVING CAPACITY TO REGISTER TEMPERATURE

BACKGROUND OF THE INVENTION

I. Field of the Invention

The present invention relates to dolls, with which the act of the taking of temperature may be simulated, and, more particularly, the present invention relates to dolls provided with an electrical circuit comprising a resisted heating element, which circuit is operated by the insert of a thermometer through an aperture provided in the body of the doll, and wherein the heat generated by the resistive heating element is registered on the thermometer, thereby providing for simulation of the act of "taking temperature."

II. Description of the Prior Art

Traditionally, many types of toys associated with the medical arts have been provided for children. Toys related to the medical arts are provided to educate, as well as to amuse. However, toys dealing with the medical arts generally comprise inoperative replicas of medical equipment, thereby, precluding the advantages that could be achieved through observation of realistic phenomenon. Such toys therefore do not achieve the benefits that would result from exposing children to quantitative measuring techniques. Such exposure would stimulate interest in numbers as well as in quantitative theory. Major advantages, therefore, would be realized by providing an operable toy with which results may be observed and quantitative measurement theory and technique demonstrated.

Applicant is aware of the following patents which relate to applicant's invention:

U.S. Pat. Nos. 1,108,046, 2,957,273 and 2,781,611. These patents do not suggest applicant's invention in that they fail to declose the major advancement in the medical arts toys field that is provided by applicant's toy which permits a child to simulate the act of taking the temperature of a doll, and to achieve a realistic, easily appreciable quantitatively measureable result.

III. Prior Art Statement

Applicant is not aware of any relevant prior art other than the aforementioned prior art.

SUMMARY OF THE INVENTION

The present invention which will be described subsequently in greater detail comprises an electric circuit having a power source and a resistive heating element deployed within the body of a toy doll. The present invention contemplates the use of a thermometer, adapted to effect the completion of the electric circuit and to measure and register the heat generated by the resistive heating element thereof. The present invention further contemplates the use of a thermometer constructed of a shatter proof material, such as plastic, and having a non-toxic substance, such as alcohol, in its capillary tube.

It is therefore an object of the present invention to provide a new and improved toy doll which permits a child to simulate the act of taking the temperature of the doll.

Other objects, advantages and applications will be readily appreciated by those skilled in the art of toy dolls when the accompanying description of one example of the best mode contemplated for practicing the invention is read.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENTS

Figure 1:
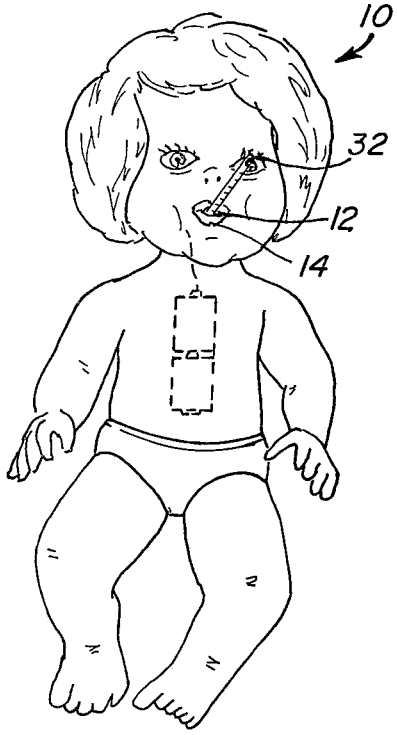
FIG. 1 is a front elevational view, of a doll constructed in accordance with the principles of the present invention and depicting in phantom lines the installation of a circuit of the present invention within the body of a doll.

Referring now to the drawing, and, in particular to FIG. 1 wherein there is illustrated one example of the present invention in the form of a doll 10. The doll 10 may be of either gender and may posess any physical attributes or characteristics deemed desirable, without departing from the scope of the present invention. The doll 10 is provided with an aperture 12 which is preferably located in the doll's mouth, although an equally realistic effect may be achieved by providing the aperture 12 at a point appropriate for insertion of the rectal type thermometer. The rear of the doll 10 is further provided with an opening 13 which mounts a removable panel 14 permitting access to the interior of the doll 10 for the purpose of the servicing or repair thereof.

Figure 2:
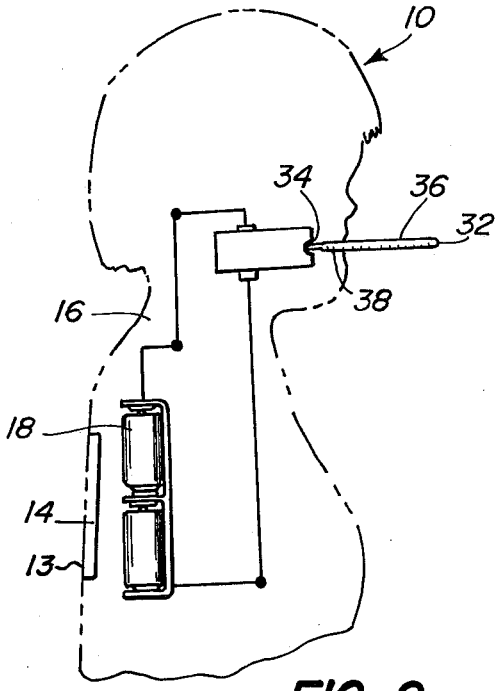
FIG. 2 is a schematic diagram of the doll and electirc circuit illustrated in FIG. 1.

In the first embodiment, as illustrated in FIG. 2, the interior of the doll 10 has an electric circuit 16 which comprises a power source 18 and a resistive heating element 20. Preferably the power source 18 comprises two nine volt batteries. The resistive heating element 20 is adapted to be movably positioned between opposing conductive contacts 22 and 24. The posts 22 and 24 are, in turn, electrically connected to the power source 18. The resistive heating element 20 is deployed behind the aperture 12 provided in the doll 10 and the element 20 is preferably provided with a narrow recess 26 directly opposite the aperture 12.

Figure 3:
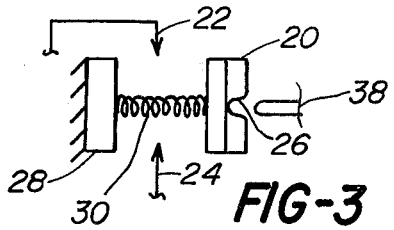
FIG. 3 is a fragmentary enlarged view of a portion of the doll illustrated in FIG. 2.

As can best be seen in FIG. 3 the doll 10 further comprises an internal stationary wall 28 having a spring 30 affixed thereto. The wall 28 and spring 30 are constructed of non-conductive material and are so deployed with respect to the conductive contacts 22 and 24 that the spring 30 abuts and is affixed to the resistive heating element 20.

The spring 30 resiliently maintains the resistive heating element 20 at a sufficient distance from the contacts 22 and 24 such that it will not inadvertently contact the conductive contacts 22 and 24. Thus the circuit 16 is normally in an open position.

As can best be seen in FIG. 2 the present invention further comprises a thermometer 32 having a tip 34 and an extended shank 36. The shank 36 is constructed from a transparent material, preferably a durable, shatterproof material such as plastic. The shank 36 of the thermometer 32 is provided with a temperature scale 38 extending along its length. A capillary tube 40 is disposed within the shank 36 and contains a substance 42 which expands when heated. The substance 42 should preferably be a non-toxic fluid, such as alcohol, in order to eliminate any possible danger to young children. The thermometer tip 34 is constructed from a heat conductive material preferably metal and is in communication with the capillary tube 40. It is further contemplated that the tip 34 of the thermometer 32 be adapted to be received into the aperture 12 of the doll 10 and to rest in the narrow recess 26 (FIGS. 2 and 3) provided in the resistive heating element 20.

The play operation of "taking the doll's temperature" is achieved by inserting the thermometer 32 within the doll aperture 12. When the thermometer 32 is inserted into the aperture 12 of the doll 10, the thermometer tip 34 abuts the resistive heating element 20 and is received into the narrow recess 26. When pressure is applied to the thermometer 32, the resistive heating element 26 is pushed in a direction of the stationary wall 28, thereby compressing the spring 30 and bringing the resistive heating element 20 into alignment and thus into electrical communication with the conductive contacts 22 and 24 thereby closing the circuit 16. When the circuit 16 is closed in this manner, current flowing from the power source 18 causes the resistive heating element 20 to heat. As the tip 34 of the thermometer 32 is pressed against said resistive heating element 20 the heat enamating therefrom will be transferred through the metal tip 34 to the substance 42 in the capillary tube 40, causing the substance 42 to expand and rise within the thermometer 10, thereby registering a temperature on the scale 38 of the thermometer 32.

Figure 4:
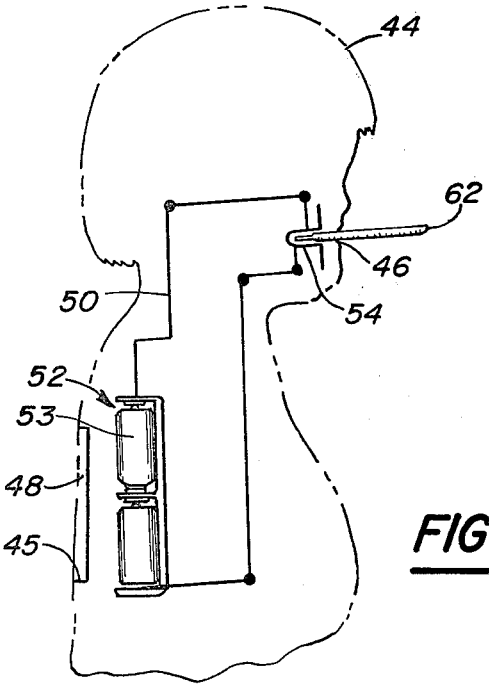
FIG. 4 is a schematic diagram of a second embodiment of the present invention.
Figure 5:
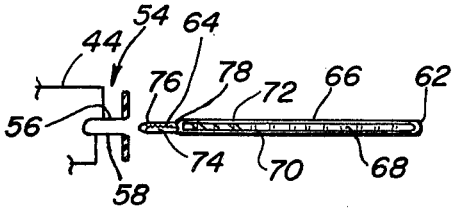
FIG. 5 is a fragmentary enlarged view of a portion of the doll illustrated in FIG. 4.

Refering now to FIGS. 4 and 5 there is illustrated a second example of the present invention in the form of a doll 44 which is provided with an aperture 46 adapted to receive a thermometer 62. The doll 44 is further provided with a rear opening 45 which supports a removable panel 48 permitting access to the interior of the doll 44 for the purpose of servicing or repair.

The doll 44 has an electric circuit 50 comprising a power source 52 in the form of two nine volt batteries 53.

The circuit 50 further comprises a socket 54 having two electrical contacts 56 and 58. It is preferred that the electrical contacts 56 and 58 be laterally spaced and situated on opposing walls of the socket 54. This preferred configuration will minimize the risk of injury resulting from insertion of metal objects into the aperture 46.

The thermometer 62 of the second embodiment comprises a tip 64 and an extended shank 66. The shank 66 is constructed of transparent material, preferably a durable, shatter-proof material, such as plastic, and is provided with a temperature scale 68 extending along its length. A capillary tube 70 is disposed within the shank 66 and contains a substance 72 which expands when heated. Similar to the thermometer 32, the substance 72 should preferably be a non-toxic fluid, such as alcohol, in order to eliminate any possible danger to young children. The tip 64 of the thermometer 62 is in communication with the capillary tube 70.

The tip 64 of the thermometer 62 is adapted to be matingly received into the socket 54. The tip 64 of the thermometer 62 contains a resistive heating element 74 and electrical contacts 76 and 78. The electrical contacts 76 and 78 preferably comprise two bands extending around the perimeter of the tip 64 at predetermined spaced intervals, such that the contacts 76 and 78 will be in alignment with and and thus in electrical communication with the contacts 56 and 58 disposed within the socket 54 when the thermometer tip 64 is inserted completely within the socket 54.

In practicing the second embodiment of the present invention, insertion of the thermometer 62 through the aperture 46 will cause the tip 64 of the thermometer 62 to extend completely into the socket 54. In this position, the electrical contacts 76, 78 on the tip 64 will be in electrical communication with the contacts 56 and 58 disposed within the socket 54. Power from its power source 52 will cause the resistive heating element 74 within the thermometer tip 64 to heat, and the heat generated thereby will cause the fluid 72 within the capillary tube 70 of the thermometer 62 to expand, and thus, register a temperature on the scale 68 provided thereon.

Obviously, many modifications and variations of the present invention are possible in light of the above teachings. It is therefore, to be understood that within the scope of the appended claims, the invention may be practiced otherwise than as specifically described.

Having, thus, described the invention, what is claimed is:

1. A doll and thermometer in combination wherein said doll is provided with an aperture and an electric circuit comprising:

a power source;

at least one resistive heating element; and means operable to open and close said circuit and wherein said thermometer, when inserted into the doll through said aperture, disposes said resistive heating element in electrical connection with said power source with the heat generated by said resistive heating element being registered on said thermometer.

2. The combination of claim 1 wherein said aperture is located in the doll's mouth.

3. The combination of claim 1 wherein said doll is provided with opening means permitting access to said power source.

4. The combination of claim 1 wherein said means operable to open and close said circuit comprises:

a stationary wall;

a spring; and two conductive posts wherein said spring abuts said resistive heating element and resiliently maintains same without the circuit, and wherein said resistive heating element is pressed into electrical communication with said conductive posts, and the circuit thereby closed, by pressure applied to same by insertion of said thermometer through said aperture.

5. The combination of claim 4 wherein said resistive heating element is provided with a recess suitable to receive the tip of the thermometer.

6. The combination of claim 4 wherein said power source comprises two nine volt batteries.

7. A doll and thermometer in combination wherein said doll is provided with an aperture and a partial electric circuit comprising a power source and a socket, having at least two electrical contacts disposed therewithin and adapted to receive matingly said thermometer; and wherein said thermometer has disposed within its tip a complementary partial circuit comprising a resistive heating element in electrical communication with at least two electrical contacts such that when the said thermometer is inserted into said doll through said aperture, and its tip received matingly into said socket, said two partial circuits form a closed circuit between said power source and said resistive heating element and the heat generated, by said resistive heating element within the thermometer's tip will be registered on said thermometer.

8. The combination of claim 7 wherein said aperture is located in the doll's mouth.

9. The combination of claim 7 wherein said doll is provided with opening means permitting access to said power source.

10. The combination of claim 1 wherein the thermometer comprises:

a capillary tube;

a fluid disposed in said capillary tube expandable when heated; and wherein the heat generated by the resistive heating element causes said fluid to expand such that the highest level of said fluid registers a simulated temperature on said thermometer.

11. The combination of claim 10 wherein the fluid is alcohol.

* * * * *